US008784688B2

(12) United States Patent
Ljunggren

(10) Patent No.: US 8,784,688 B2
(45) Date of Patent: Jul. 22, 2014

(54) METHOD AND DEVICE FOR CARBON INJECTION AND RECIRCULATION OF SYNTHESIS GAS WHEN PRODUCING SYNTHESIS GAS

(75) Inventor: Rolf Ljunggren, Sollentuna (SE)

(73) Assignee: Cortus AB, Kista (SE)

( * ) Notice: Subject to any disclaimer, the term of this patent is extended or adjusted under 35 U.S.C. 154(b) by 0 days.

(21) Appl. No.: 13/695,624

(22) PCT Filed: May 5, 2011

(86) PCT No.: PCT/SE2011/000079

§ 371 (c)(1),
(2), (4) Date: Nov. 1, 2012

(87) PCT Pub. No.: WO2011/139199

PCT Pub. Date: Nov. 10, 2011

(65) Prior Publication Data

US 2013/0048916 A1 Feb. 28, 2013

(30) Foreign Application Priority Data

May 6, 2010 (SE) ..... 1000461

(51) Int. Cl.
*B05B 1/00* (2006.01)
*C01B 3/02* (2006.01)

(52) U.S. Cl.
USPC ..... 252/373; 239/589

(58) Field of Classification Search
None
See application file for complete search history.

(56) References Cited

U.S. PATENT DOCUMENTS

| | | | | |
|---|---|---|---|---|
| 2,829,957 | A | 4/1958 | Carkeek | |
| 4,019,783 | A | 4/1977 | Kayser | |
| 2007/0272538 | A1* | 11/2007 | Satchell | 201/35 |

FOREIGN PATENT DOCUMENTS

| | | | |
|---|---|---|---|
| DE | 40 25 909 | A1 | 7/1991 |
| EP | 0 198 700 | A2 | 10/1986 |
| GB | 713 004 | A | 8/1954 |

OTHER PUBLICATIONS

International Search Report, dated Jul. 21, 2011, from corresponding PCT application.

* cited by examiner

*Primary Examiner* — Melvin C Mayes
*Assistant Examiner* — Douglas Call
(74) *Attorney, Agent, or Firm* — Young & Thompson

(57) ABSTRACT

Method and device for introducing pulverulent material (C) into a gasification reactor (2), wherein a process gas (P) supplied to a gasification reactor (2) is reduced to a synthesis gas (S) by the pulverulent material (C) and the pulverulent material (C) is introduced into the gasification reactor (2) via an inlet area, a negative pressure being generated in the inlet area for the pulverulent material (C) via a Laval nozzle (15) and the negative pressure being generated in that the process gas (P) passes through the Laval nozzle (15). The method is characterized in that the process gas (P) expands in a gasification space (5) in the gasification reactor (2).

14 Claims, 2 Drawing Sheets

METHOD AND DEVICE FOR CARBON INJECTION AND RECIRCULATION OF SYNTHESIS GAS WHEN PRODUCING SYNTHESIS GAS

TECHNICAL FIELD OF THE INVENTION

This invention relates to a method and a device for carbon injection and recirculation of gases when producing synthesis gas from solid carbon particles, wherein the carbon particles are preferably obtained by pyrolysis and gasification of the carbon particles is effected by heating the carbon particles indirectly in the presence of a process gas in the same space in which the carbon particles are situated, the reaction product being recirculated and the synthesis gas produced during the gasification being discharged from the said space. In order to achieve the best possible effect, the device includes a Laval nozzle for accelerating gases to supersonic speed and for creating negative pressure for the injection of powdered carbon and longer dwell times for gas and powdered carbon in the gasification reactor.

STATE OF THE ART

Devices for carbon injection when producing synthesis gas are required to allow for the gasification of carbon-bearing material in a gasification process.

Gasification is a process for producing gaseous fuel from solid fuel. The technique is used for coal, residual products of coal, petroleum residues, waste and biomass. The reactions are based on oxidising gases (e.g. $CO_2$ and $H_2O$) being heated by substoichiometric combustion and then reacting with carbon ([C] reducing agent), with carbon monoxide (CO) and hydrogen ($H_2$) being formed as heat is consumed in order to carry on the reactions, which are endothermic. The gaseous mixture of carbon monoxide (CO) and hydrogen ($H_2$) is usually referred to as synthesis gas.

One common gasification method is the highly substoichiometric combustion of carbon-bearing materials while supplying superheated steam. The combustion supplies the system with heat and flue gases ($CO_2$ and $H_2O$). Carbon which is not burnt but is now superheated reacts with flue gases and the steam supplied. The carbon (C) reduces carbon dioxide ($CO_2$) to carbon monoxide (CO) and water vapour ($H_2O$) to hydrogen ($H_2$). The heat consumed lowers the temperature and reactivity decreases. Carbon reactivity is highly temperature-dependent, while the equilibrium of the reactions is temperature-dependent. Oxygen-based combustion is currently the predominant combustion method in connection with gasification, although air-based combustion is also found. Most processes are based on a pressurised system. Steam and oxygen are easily pressurised and rarely cause problems. The introduction of, e.g. pulverulent material into the reactor means that a pressure difference between the atmosphere outside the gasification reactor and the pressure inside it has to be overcome.

The problem with the gasification of carbon-bearing materials such as coal, residual products of coal, petroleum residues, waste and biomass as described hereinabove consists in maintaining a sufficiently high temperature for a sufficiently long period of time to achieve the complete gasification of carbon-bearing material, effecting sufficient mixing of oxidising gases ($CO_2$ and $H_2O$) with the reducing agent (carbon) and overcoming pressure differences between the atmosphere outside and inside the gasification reactor. If the time and temperature cannot be maintained, the reaction will not be carried on to its completion, with insufficient mixing also leading to an incomplete reaction.

This invention is a device for carbon injection when producing synthesis gas which injects pulverulent material by means of a tubular injector, wherein the solid material goes into the centre thereof and a surrounding nozzle device of the Laval type for oxidising gases for creating a strong negative pressure which sucks the carbon into the injector and furthermore distributes it into the gasification reactor effects the increase in pressure, extends the dwell time in the reactor and creates a homogeneous mixture therein. The strong momentum of the oxidising gases brings about vigorous mixing of the synthesis gas in the gasification reactor with the incoming oxidising gases and the pulverulent material. The negative pressure created by the gas momentum can be controlled by recirculating some of the synthesis gas in the gasification reactor through the injector in channels provided to this end therein.

AIMS AND FEATURES OF THE INVENTION

A first aim of this invention is to provide a device of the type defined in the introductory part, an essential principle of this invention being to create a negative pressure in order to facilitate the introduction of pulverulent material into the gasification reactor by means of the injector.

Another aim of this invention is to create vigorous agitation between the oxidising gases and the pulverulent material as they are introduced into the gasification reactor and to recirculate synthesis gas in the gasification reactor, thereby achieving uniformity of temperature and composition. This results in a longer dwell time in the reactor and thus allows for a more compact reactor design.

Yet another aim of this invention is to recirculate synthesis gas through the injector and to control the negative pressure as pulverulent material is introduced into the gasification reactor in this manner.

BRIEF DESCRIPTION OF THE DRAWINGS

One preferred embodiment of the invention will now be described with reference to the accompanying drawings, in which.

DETAILED DESCRIPTION OF A PREFERRED EMBODIMENT OF THE INVENTION

Figure 1:
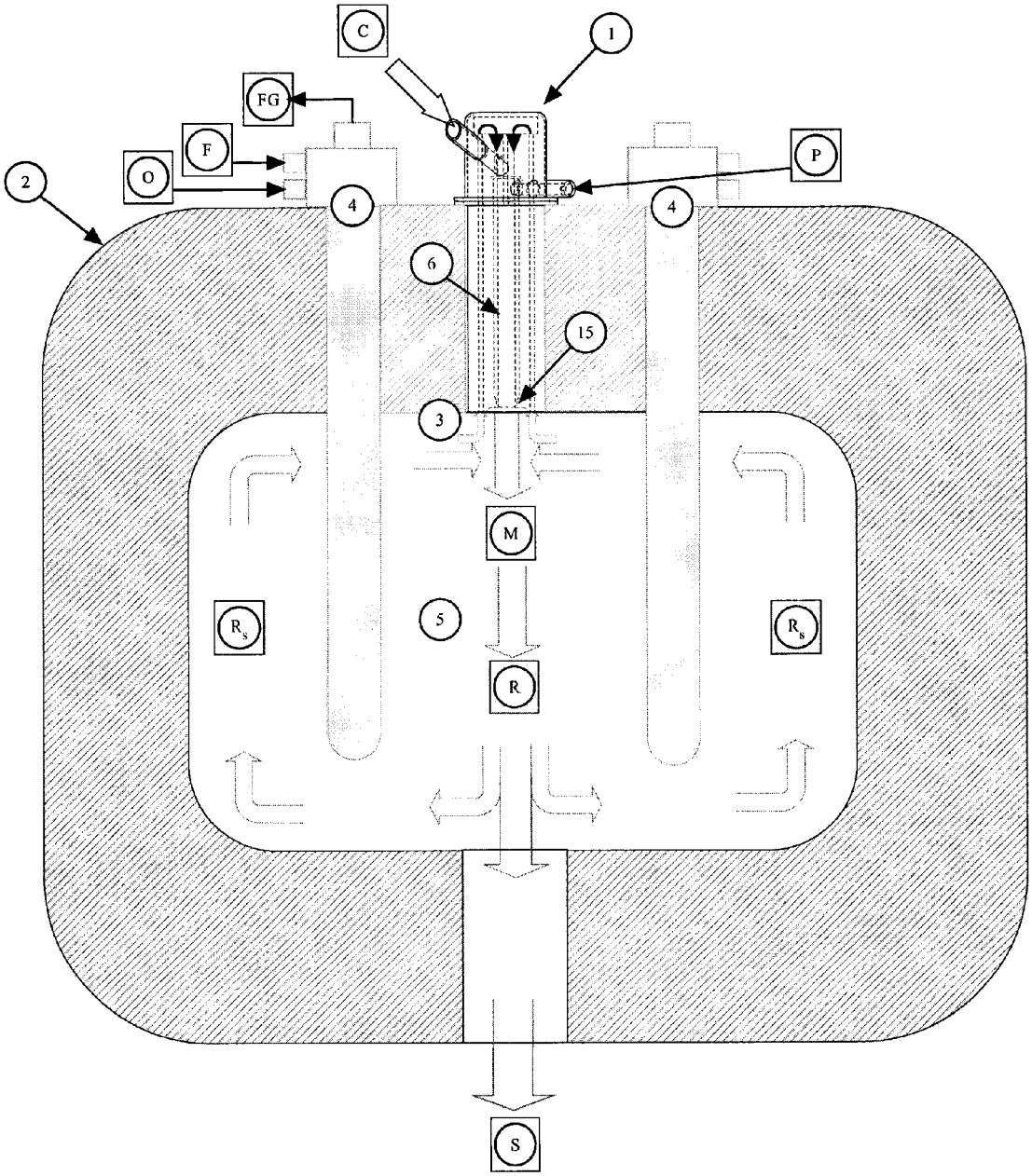
FIG. 1 is an outline sketch of a device for carbon injection when producing synthesis gas according to this invention, the said outline sketch also showing units forming a device for carrying out the carbon injection in diagrammatic form.

FIG. 1 is a diagram showing a device for carbon injection in a gasification process in which powdered carbon C is fed into an injection nozzle 1 which mixes the powdered carbon C with a process gas P (preferably steam) and a recirculated reaction product $R_s$ (synthesis gas). The mixture from the injection nozzle 1 is heated and reacts in an indirectly heated gasification reactor 2. To this end, the gasification reactor 2 includes burners 4 extending in a gasification space 5 in the gasification reactor 2, the burners 4 providing for indirect heating of the gasification reactor 2. The process gas P is pressurised and accelerates to supersonic speed (Mach>1)

through an annular Laval nozzle 15 incorporated into the injection nozzle 1. The Laval nozzle 15 creates a strong negative pressure in the centre of the injection nozzle 1, a central tube/central channel 6 for powdered carbon C and recirculated reaction product $R_s$ (synthesis gas) incorporated into the injection nozzle 1 opening into the gasification reactor 2.

The region in which the central tube 6 of the injection nozzle 1 opens into the gasification reactor 2 defines an inlet area for the powdered carbon C. The negative pressure in the centre of the injection nozzle 1/inlet area sucks out powdered carbon C and recirculated reaction product $R_s$ where the three streams are mixed and the gasification reaction starts. The process gas P flowing at supersonic speed through the annular Laval nozzle 15 also results in further recirculation from the periphery thereof. Further reaction product is incorporated into the gasification mixture from the injection nozzle 1 in the centre of the mixing zone M immediately in front of the injection nozzle 1 itself. Heat from the recirculated reaction product $R_s$ helps the indirect radiant heat in the gasification reactor 2 to rapidly increase the temperature of the injected powdered carbon C and process gas P to reaction temperature for the gasification process.

Negative pressure generated in the inlet area results in the circulation of gases and particles in the gasification reactor 2, thereby compensating for concentration differences in the gas composition, compensating for temperature variations as a result of gasification reactions and minimising the stationary beds around burners 4 arranged in the gasification reactor 2.

The pipes, tubes, etc. connecting the units of the plant are not described nor shown in detail. The pipes, tubes, etc. are designed in a suitable manner to perform their function, i.e. to transport gases and solid substances between the units of the plant.

FIG. 1 shows the principles of an injection nozzle 1 connected to an indirectly heated gasification reactor 2, normally a ceramically lined reactor. The injection nozzle 1 has a Laval nozzle 15 for process gas P which accelerates the process gas P to supersonic speed. The annular Laval nozzle 15 is arranged on the outside of the central tube/central channel 6. The synthesis gas S in the process is produced primarily in the gasification reactor 2.

Solid carbon particles C are supplied to the injection nozzle 1 together with the process gas P and some of the recirculated secondary reaction product Rs. The negative pressure for the carbon injection can be controlled occasionally as a result of the fact that the secondary reaction product Rs flows through separate channels 14 in the injection nozzle 1. The cross-sectional dimensions of the separate, i.e., further channels 14 can be varied, thereby adjusting the negative pressure created by the Laval nozzle 15. The carbon particles C preferably originate from pyrolysis preceding the gasification. The size of the carbon particles C is preferably adapted to give the fastest possible reaction in the reactor. The process gas P can be steam or recovered and purified flue gas from, e.g. the combustion phase heating the reactor. If the process gas P is recovered flue gas, it can contain both water vapour ($H_2O$) and carbon dioxide ($CO_2$). The process gas P is normally preheated by heat recovered from the outgoing synthesis gas S in a downstream heat exchanger. The process gas P normally has an excess pressure which is sufficiently high relative to the reactor pressure to achieve supersonic speed. The process gas P having a speed Mach>1 creates strong momentum in the gasification reactor 2. The pressure for steam is dependent on the temperature out of the abovementioned heat exchanger. If flue gas is used instead of steam, the pressure of the recirculated flue gas is normally created by a compressor.

The momentum of the process gas P out of the injection nozzle 1 results in the recirculation of secondary reaction product Rs entrained into the reaction zone R in the mixing zone M. The reaction taking place in the gasification reactor 2 is that the carbon C reduces the contents of the process gas P ($H_2O$ and $CO_2$) to synthesis gas S (H2 and CO), this reduction consuming the heat supplied to the process by burners 4 which heat indirectly. Heat is supplied to the gasification reaction by radiation from burners 4, with the combustion taking place inside radiant tubes in that fuel F and oxidising agent O are burnt to give flue gas FG, i.e. separated from the gasification flow. There is no direct gas yield in the gasification reactor 2 between burners 4 and process gas P or its reaction products. By imparting supersonic speed to the process gas P, the injection nozzle 1 provides for an extended dwell time in the reactor 2 and the gasification reaction can be carried on closer to equilibrium. This also results in the greatest possible degree of burn-out for the carbon particles C.

Outgoing synthesis gas S can be used as energy gas for combustion purposes or as the basis for further refinement to liquid fuels (Fischer-Tropsch process for typical vehicle fuels, methanol production or the like).

The injection nozzle 1 is designed to handle different system pressures in the gasification reactor 2. The pressure in 2 can be controlled from atmospheric pressure to very high pressure (>100 bar). The injection nozzle 1 is typically designed with a ceramic part adapted to the ceramic lining in the gasification reactor 2 and an outer part made of heat-resistant steel, in which channels for carbon (C), process gas (P) and recirculated reaction gas ($R_s$) are located and are ultimately brought together out of the lower end of the nozzle. The injection nozzle must always have a feed pressure for the process gas P higher than the system pressure in the gasification reactor 2. This pressure difference also creates the negative pressure which sucks out carbon particles C and entrains secondary reaction product $R_s$. The Laval nozzle 15 creates a strong negative pressure in relation to the mass flow of process gas P as the pressure is high compared to a standard injector with straight tubes. The strong negative pressure from the Laval nozzle 15 is advantageous for controlling the ratio between the mass flow of carbon C and the process gas P in the gasification reactor 2 and thereby for achieving optimum reaction conditions.

The choice of material for the injection nozzle 1 depends on the temperature in the gasification reactor 2, which in turn depends on the reaction temperature, to achieve the maximum yield of synthesis gas S. A typical value is in the range of 900-1300° C. The choice of material for ceramic and metal parts in the injection nozzle 1 is adapted to the selected temperature level. Temperature uniformity in the reaction zone R is achieved more rapidly than in the case of normal injection nozzles as a result of the recirculation of reaction gas $R_s$ partly through the channels 3 in the injection nozzle 1 and partly through the mixing zone M.

The synthesis gas S ($H_2$ and CO) from the gasification reactor 2 contains hydrogen and carbon monoxide, as well as a certain amount of carbon dioxide and methane depending on the composition of the incoming process gas P and the selected temperature.

Figure 2:
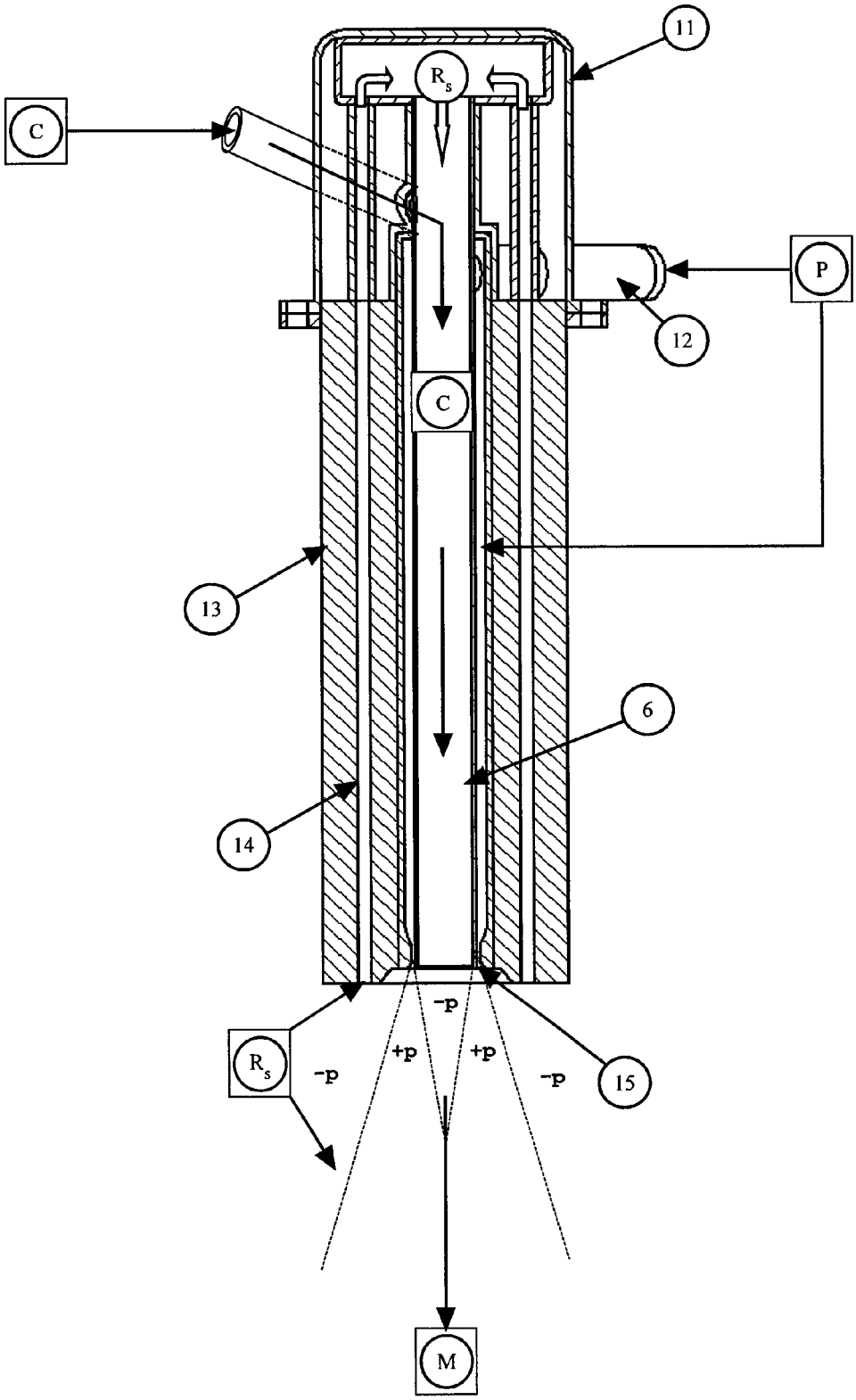
FIG. 2 is an outline sketch of one embodiment of a device for carbon injection when producing synthesis gas according to this invention, the said outline sketch also showing units forming a device for carrying out the carbon injection in diagrammatic form.

FIG. 2 shows an embodiment of a device for carbon injection when producing synthesis gas. The injection nozzle 1 consists of a metal part 11 and a ceramic part 13 forming one unit. The injection nozzle has a Laval nozzle 15 for process gas P through which the pressurised gas accelerates to supersonic speed. Powdered carbon C is fed typically by means of a feed screw and a plug flow to the central tube/central channel 6 where the powder is mixed with recirculated reaction product $R_s$ sucked in through further channels 14. The process gas P (preferably steam) is fed through a connection 12 through a concentric tube down to the Laval nozzle 15 where the process gas (steam) at excess pressure is accelerated strongly to supersonic speed (Mach>1) by the Laval nozzle 15 with expansion out of the nozzle (+p) and creates a negative pressure (−p) in the centre which entrains powdered carbon C and recirculated reaction product $R_s$ into the mixing zone M where the periphery of the Laval nozzle 15 also creates a negative pressure (−p) and recirculates reaction product $R_s$ in the mixing zone M.

POSSIBLE MODIFICATIONS OF THE INVENTION

In an alternative embodiment, the injection nozzle can be used with a mixture of process gas as described hereinabove with the addition of oxygen, this significantly increasing the temperature in the mixing zone M and the reaction zone R.

In another alternative embodiment, the injection nozzle is horizontal, the carbon injection C then taking place in the horizontal plane or as close to the horizontal plane as the process will allow.

Feeding of the powdered carbon C can be effected by means of a hydraulic piston instead of a feed screw as described in FIG. 2 hereinabove. Yet another alternative is for the powdered carbon C to be fed via a fluidised channel with gastight transfer to a vertical tube in the injection nozzle by means of a lock feeder.

When a gastight carbon feed system subjected to negative pressure is used, the pressure-regulating channels 14 in FIG. 2 can also be minimised or even omitted.

In the embodiment described hereinabove, a secondary reaction product $R_s$ is recirculated via channels 14 arranged in the injection nozzle 1. As an alternative to this arrangement, the synthesis gas S discharged from the gasification reactor 2 can instead be recirculated in the central tube/central channel 6 of the injection nozzle 1. From a purely practical point of view, this is achieved by means of a recirculation pipe arranged external of the gasification reactor 2.

The invention claimed is:

1. A method of introducing pulverulent material (C) into a gasification reactor (2), via an injection nozzle comprising:

supplying a process gas (P) to the gasification reactor (2) to be reduced to a synthesis gas (S) by the pulverulent material (C);

introducing the pulverulent material (C) into the gasification reactor (2) via an inlet area;

mixing recirculated reaction product ($R_s$) with the pulverulent material (C) within the injection nozzle as the pulverulent material (C) is introduced into the gasification reactor (2), the reaction product being recycled synthesis gas; and generating a vacuum in the inlet area via a Laval nozzle (15) and the vacuum being generated so that the process gas (P) passes through the Laval nozzle (15), wherein the process gas (P) expands in a gasification space (5) in the gasification reactor (2).

2. The method according to claim 1, wherein the pulverulent material is powdered carbon (C).

3. The method according to claim 2, wherein the negative pressure generated in the inlet area sucks in gases and particles situated in the gasification reactor (2), thereby extending a dwell time of the gases and particles in the gasification reactor (2).

4. The method according to claim 2, wherein the vacuum generated in the inlet area results in the circulation of gases and particles in the gasification reactor (2), thereby compensating for concentration differences in the gas composition, compensating for temperature variations as a result of gasification reactions and minimising stationary beds around burners (4) arranged in the gasification reactor (2).

5. The method according to claim 1, wherein the process gas is steam.

6. The method according to claim 1, wherein the process gas accelerates to supersonic speed through the Laval nozzle.

7. The method according to claim 1, wherein the reaction product is synthesis gas.

8. The method according to claim 1, wherein the vacuum in a center of the inlet area sucks out the powdered carbon and the reaction product Rs where three streams are mixed and the gasification reaction starts.

9. The method according to claim 1, wherein the vacuum in the inlet area sucks in gases and particles situated in the gasification reactor (2), thereby extending a dwell time of the gases and particles in the gasification reactor (2).

10. The method according to claim 1, wherein the vacuum generated in the inlet area results in the circulation of gases and particles in the gasification reactor (2), thereby compensating for concentration differences in the gas composition, compensating for temperature variations as a result of gasification reactions and minimising stationary beds around burners (4) arranged in the gasification reactor (2).

11. The method according to claim 10, wherein the vacuum generated in the inlet area results in the circulation of gases and particles in the gasification reactor (2), thereby compensating for concentration differences in the gas composition, compensating for temperature variations as a result of gasification reactions and minimising stationary beds around burners (4) arranged in the gasification reactor (2).

12. A device for introducing pulverulent material (C) into a gasification reactor (2), wherein a process gas (P) supplied to the gasification reactor (2) is reduced to a synthesis gas (S) by the pulverulent material (C), wherein the device comprises:

an injection nozzle (1) comprising a central tube/central channel (6) provided in the injection nozzle configured for introducing the pulverulent material (C) into the gasification reactor (2); and a Laval nozzle (15) arranged on an outside of the central tube (6), wherein the central tube/central channel (6) opens directly into a gasification space (5) in the gasification reactor (2), and the injection nozzle (1) includes further channels (14) for the recirculation of a reaction product ($R_s$) and that the further channels (14) communicate with the central tube/central channel (6) in a region of an end of the injection nozzle (1) directed away from the gasification space (5) in the gasification reactor (2).

13. The device according to claim 12, wherein the Laval nozzle (15) is arranged at the end of the injection nozzle (1) directed towards a gasification space (5) in the gasification reactor (2).

14. The device according to claim 12, wherein the cross-sectional dimensions of the further channels (14) can be varied, thereby adjusting the negative pressure created by the Laval nozzle (15).

* * * * *